US010124919B2

(12) United States Patent
Yoshikane et al.

(10) Patent No.: US 10,124,919 B2
(45) Date of Patent: Nov. 13, 2018

(54) METHOD FOR OPENING SPOUT ATTACHMENT PORTION OF A BAG

(71) Applicant: Toyo Jidoki Co., Ltd., Minato-ku, Tokyo (JP)

(72) Inventors: Tohru Yoshikane, Iwakuni (JP); Jyunji Yamasaki, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 564 days.

(21) Appl. No.: 14/801,690

(22) Filed: Jul. 16, 2015

(65) Prior Publication Data

US 2016/0016693 A1 Jan. 21, 2016

(30) Foreign Application Priority Data

Jul. 17, 2014 (JP) ..... 2014-146882

(51) Int. Cl.

| | |
|---|---|
| ***B65B 43/36*** | (2006.01) |
| ***B31B 70/00*** | (2017.01) |
| ***B65B 43/34*** | (2006.01) |
| ***B31B 1/00*** | (2006.01) |

(Continued)

(52) U.S. Cl.

CPC ..... *B65B 43/36* (2013.01); *B31B 1/00* (2013.01); *B31B 70/003* (2017.08); *B65B 43/34* (2013.01); *B31B 70/844* (2017.08); *B31B 2219/9054* (2013.01); *B65D 33/16* (2013.01)

(58) Field of Classification Search

CPC ..... B31B 70/003; B31B 70/81; B31B 70/84; B31B 70/844; B65B 43/26; B65B 43/262; B65B 43/28; B65B 43/30; B65B 43/32; B65B 43/34; B65B 43/36; B65B 43/50; B65B 61/186; B65B 3/045; B65B 3/17;

(Continued)

(56) References Cited

U.S. PATENT DOCUMENTS 4,019,546 A * 4/1977 Hastrup ..... B65B 1/18 141/10
5,606,844 A * 3/1997 Takagaki ..... B29C 65/08 53/133.2

(Continued)

FOREIGN PATENT DOCUMENTS

DE 3441947 A1 * 5/1986 ..... B65B 43/30
EP 2 712 727 A2 4/2014

(Continued)

*Primary Examiner* — Stephen F Gerrity
*Assistant Examiner* — Joshua Kotis
(74) *Attorney, Agent, or Firm* — Norton Rose Fulbright US LLP

(57) ABSTRACT

A method and device for opening spout attachment portion of a bag being set up such that films on both sides of a spout attachment portion (2) of a bag (1) are suction-held up by a pair of suction cups (8), and the spacing between the pair of suction cups is widened to open the spout attachment portion, after which a gas is blown from the spout attachment portion into the bag by a gas blowing member (9); and when the gas is blown into, a clamping member (19) clamps a position under the gripper that is on the top edge (6) side of the bag from both sides of the bag, thus suppressing outflow of the gas blown into the bag from the top edge, thus allowing entire bag to inflate for its entirety substantially and the spout attachment portion to be kept opened.

2 Claims, 10 Drawing Sheets

(51) Int. Cl.
*B31B 70/84* (2017.01)
*B65D 33/16* (2006.01)

(58) Field of Classification Search
CPC ..... B65B 3/18; B65B 31/046; B65B 31/048; B65B 31/041; B65B 31/06; B31D 5/0073
USPC ... 53/457, 459, 492, 570, 384.1–386.1, 403, 53/410, 133.2, 472, 79, 92; 493/210, 493/213; 383/3
See application file for complete search history.

(56) References Cited

U.S. PATENT DOCUMENTS 6,655,114 B2 * 12/2003 Hiramoto ..... B29C 65/18 53/479
8,567,160 B2 * 10/2013 Gustafsson ..... B65B 61/14 53/134.1
9,221,569 B2 * 12/2015 Nakamoto ..... B65B 43/465
2005/0271306 A1 * 12/2005 Murray ..... B29C 65/08 383/38
2006/0199716 A1 * 9/2006 Tsutsui ..... B29C 65/18 493/87
2007/0257047 A1 * 11/2007 Fukuizumi ..... B65B 61/186 220/694
2009/0077926 A1 * 3/2009 Liao ..... B31D 5/0073 53/403
2009/0241475 A1 * 10/2009 Tsutsui ..... B65B 43/18 53/459
2014/0083061 A1 * 3/2014 Ibaraki ..... B65B 3/02 53/558
2014/0096492 A1 * 4/2014 Celeste ..... B43M 3/045 53/492
2014/0102045 A1 4/2014 Yoshikane
2014/0250834 A1 * 9/2014 Yoshikane ..... B65B 31/048 53/403

FOREIGN PATENT DOCUMENTS

JP 06048401 A * 2/1994 ..... B65D 75/5883
JP H8-337217 12/1996
JP P2002-128025 A 5/2002
JP P5459114 1/2014
JP P2014-80013 A 5/2014
JP P2015-168459 A 9/2015

* cited by examiner

METHOD FOR OPENING SPOUT ATTACHMENT PORTION OF A BAG

BACKGROUND OF THE INVENTION

1. Field of the Invention

The present invention relates to a method and device for opening a spout attachment portion formed at the top end of a bag and more particularly to a method and device for opening a spout attachment portion formed by cutting off a corner that is at the top edge and one side edge of a bag. The present invention is applicable to, for example, an apparatus that manufactures bags that have spouts.

2. Description of the Related Art

Patent Reference 1: Japanese Patent Application Laid-Open (Kokai) No. 2014-80013

Patent Reference 2: Japanese Patent No. 5,459,114

Patent Reference 1 discloses how a bag that is equipped with a spout is manufactured. In this art, a pair of left and right grippers clamp or hold both sides of a spout attachment portion of each one of bags in which the spout attachment portion has been formed by cutting off a corner of the top edge and one side edge of the bag, the bag is hung down so that the spout attachment portion is substantially horizontal, and the thus hung down bags are intermittently conveyed along a specific conveyance path; and at various stop positions along the conveyance path, an opening step, in which the spout attachment portion is opened, a spout insertion and temporary sealing step, in which a spout is inserted into the opened spout attachment portion and then temporarily sealed, and a final sealing step, in which the spout is finally sealed to the spout attachment portion, are performed. The bag disclosed in Patent Reference 1 is one that is entirely sealed including the top edge, except for the spout attachment portion. Patent Reference 1 describes that the bag is filled with its contents through the spout attachment portion, and this filling is done after opening up the spout attachment portion and before attaching the spout to the spout attachment portion.

The bag disclosed in Patent Reference 2 is one in which a spout attachment portion is formed by cutting off a corner that is at the top edge and one side edge of a bag, but neither the spout attachment portion nor the top edge is sealed. Patent Reference 2 discloses that after a spout is attached to the spout attachment portion, the top edge (an opening used for filling) of the bag is opened up, and then the bag is filled with a liquid through this opening in the top edge.

In a bag that has a corner-cut spout attachment portion and a sealed top edge, when opening the spout attachment portion (see Patent Reference 1), it is preferable that the bag surfaces near the spout attachment portion (more specifically, the films on both sides of the bag) be suction-held by a pair of opening suction cups, the suctions cups be then retracted to open up the spout attachment portion, and then using a gas blowing member (see Japanese Patent Application Laid-Open (Kokai) No. 2002-128025, for example) a gas is blown into the bag through the opened spout attachment portion, thus inflating the bag. These steps are taken because by way of inflating the bag, the opening shape of the spout attachment portion of a bag is allowed to be kept stable (without returning to the original, closed shape) even after the opening suction cups that suction-held the bag surfaces are separated from the bag surfaces, and the bag can be conveyed in this opened state to the next step.

On the other hand, for the bag disclosed in Patent Reference 2 (a bag in which the spout attachment portion and the top edge are not sealed), it is difficult to inflate the bag sufficiently even when a gas blowing member is used to keep blowing gas into the bag through the opened spout attachment portion. This aspect will be described with reference to FIG. 10.

As shown in FIG. 10, a bag 1 has a corner-cut spout attachment portion 2; and side edges 3 and 4 and a bottom edge 5 are sealed, and the spout attachment portion 2 and the top edge 6 are not sealed. As discussed in Patent Reference 1, left and right pairs of grippers 7 clamp or hold the side edge 3 and the top edge 6 on both sides of the spout attachment portion 2, and the bag 1 is allowed to be hung down so that the spout attachment portion 2 is made horizontal. The grippers 7 are the same as the left and right pairs of grippers disclosed in Patent Reference 1 in that they are moved intermittently along a specific conveyance path and intermittently convey the clamped bag 1 along a specific conveyance path.

In FIG. 10, a pair of opening suction cups 8 (only one opening suction cup 8 is shown) suction-hold the films on both sides of the bag 1 at a position slightly under the spout attachment portion 2, and then they are retracted (or moved away from each other), thus opening the spout attachment portion 2. As is commonly known, when the opening suction cups 8 are refracted, the grippers 7 are moved closer to each other so as not to hinder the opening of the spout attachment portion 2. A gas blowing member 9 disposed above the bag 1 is moved up and down; and when the spout attachment portion 2 is opened, the gas blowing member 9 is descended, the lower end of its head 9*a* is brought into the opening of the spout attachment portion 2 so as to block off the spout attachment portion 2 substantially completely, and then a pressurized gas is blown into the bag 1. The reference numeral 11 is a gas channel formed in the gas blowing member 9, one end of this gas channel opens to the lower end of the head 9*a* (the pressurized gas blow hole), and the other end of which is connected to a pressurized gas supply 12. The reference numeral 13 is an elevator member linked to the gas blowing member 9, and it is moved up and down by an elevator drive source (not shown).

Since the bag 1 is not sealed at the top edge 6, as seen from FIG. 10, when pressurized gas is blown down from the gas blowing member 9, the unclosed top edge 6 becomes an escape path for the pressurized gas, the pressurized gas freely flows out of the bag (see the white arrows in FIG. 10), the gas does not extend throughout the interior of the bag 1, and the center region 14 of the bag 1 under the spout attachment portion 2 (the region surrounded by the two-dot chain line) is particularly difficult to inflate. If this region 14 does not inflate completely, the region 14, after the opening suction cups 8 are separated from the bag surface, will return to its original closed (or flat) state under the restoration force of the films of the bag 1, which results in a narrowing, deformation, etc., of the opening of the spout attachment portion 2, which means that the opening shape of the spout attachment portion 2 tends to be unstable. In particular, when the bag is clamped or held by grippers 7 at an angle, as in this shown example, the above-described restoration force is not exerted symmetrically on both ends of the spout attachment portion 2, and the opening shape of the spout attachment portion 2 tends to be even less stable.

BRIEF SUMMARY OF THE INVENTION

It is, therefore, an object of the present invention to provide a method and device for opening a spout attachment portion formed at top end of a bag that allows a stable opening shape to be obtained even for a bag whose top edge is not sealed, and this method and device is typically employed when left and right pairs of grippers clamp both sides of a spout attachment portion of a bag in which the spout attachment portion is formed by cutting off the corner of the top edge and one of the side edges of the bag, and the bag is conveyed along a specific conveyance path while being hung down, so that on this conveyance path the spout attachment portion is kept substantially horizontal and the spout attachment portion is kept opened.

More specifically, the present invention relates to an improvement in a method for opening a spout attachment portion in which left and right pairs of grippers clamp or hold both sides of a spout attachment portion of a bag in which this spout attachment portion is formed by cutting off the corner of the top edge and one of the side edges of the bag, the bag is conveyed along a specific conveyance path while being hung down so that the spout attachment portion is substantially horizontal, and in the course of this conveyance the films on both sides of the spout attachment portion are suction-held by a pair of suction cups, and then the suction cups are moved apart to open up the spout attachment portion, after which a gas is blown into the bag by a gas blowing member to inflate the bag; and in this method, according to the present invention, the bag is one in which the top edge of the bag is not sealed, and when the gas is blown into the bag by the gas blowing member, a position under the grippers on the top edge side of the bag is clamped from both sides of the bag by clamping members, thus suppressing outflow of the gas blown into the bag from the top edge.

In the present invention, it is preferable that slippage occurs between the films of the bag and the clamping faces of the clamping members when the bag is inflated.

The device for opening a spout attachment portion of a bag according to the present invention is to carry out the above-described opening method, and it provides such a characteristic configuration as follows:

(1) The device is comprised of:

a pair of opening suction cups which are disposed to face both sides of the bag and are moved toward and away from each other, a gas blowing member which blows gas into the interior of the bag so as to inflate the bag, and a clamping member which open and close;

wherein when the clamping member closes, the position under the grippers on the top edge side of the bag is clamped from both sides of the bag by the clamping member.

Accordingly, it is less likely that the gas blown into the bag freely flows out from the top edge of the bag. The clamping member is provided so that when it opens it is retracted from the conveyance path of the bag.

(2) The device can be comprised of:

a pair of opening suction cups which are disposed to face both sides of the bag and are moved toward and away from each other, a gas blowing member which blows gas into the interior of the bag to inflate the bag, and left and right pairs of clamping members which open and close, the clamping members both having clamping faces that run along the up and down direction and wherein when one of the left and right clamping members closes, the position under the grippers on the top edge side of the bag is clamped from both sides of the bag by the closed clamping member, and when the other clamping member closes, the position under the grippers on the one side edge side of the bag is clamped from both sides of the bag by the closed other clamping member.

Accordingly, it is less likely that the gas blown into the bag freely flows out from the top edge, and the gas can be blown in more efficiently to the lower region of the spout attachment portion so as to inflate this region. The left and right pairs of clamping members are provided so that when they open both are retracted from the conveyance path of the bag.

(3) In (1) and (2) above, it is preferable that the clamping members clamp the bag with a force that is sufficient to produce slippage between the bag and the clamping faces of the clamping members when the bag is inflated.

(4) The device is further comprised of:

a pair of opening suction cups which are disposed to face both sides of the bag and are moved toward and away from each other, a gas blowing member which blows gas into the interior of the bag to inflate the bag, and left and right pairs of clamping members that open and close with the spacing in between can be increased or decreased, wherein the clamping members have clamping faces that run along the up and down direction, when one of the left and right pairs of clamping members closes, the position under the grippers on the top edge side of the bag is clamped from both sides of the bag by the closed clamping member, and when the other clamping member closes, the position under the grippers on the one side edge side of the bag is clamped from both sides of the bag by the closed other clamping member. After clamping the bag, the amount of spacing between the pair of clamping members is reduced so as to match the timing at which the pressurized gas is blown in.

Accordingly, it is less likely that the gas blown into the bag freely flows out from the top edge, and the gas can be blown in more efficiently to the lower region of the spout attachment portion so as to inflate this region. The left and right pairs of clamping members are provided so that when they open both are retracted from the conveyance path of the bag.

(5) In (1) to (4) above, the gas blowing member is moved up and down, are retracted away from the bag at the ascended position, and at the descended position the blow hole at its lower end is inserted into the bag through the spout attachment portion.

The apparatus for manufacturing a bag equipped with a spout according to the present invention is to apply the above-described opening device to a known apparatus for manufacturing a bag that is equipped with a spout. Such a known apparatus for manufacturing a bag equipped with a spout comprises a bag conveyance device provided with a plurality of left and right pairs of grippers that are disposed along a specific conveyance path and moved intermittently along the conveyance path, with the spacing between each other being increased or decreased along the conveyance path, a bag supply device that is disposed near a bag supply position, which is a stop position on the conveyance path, and that supplies empty bags in a substantially vertical orientation to the grippers, an opening device that is installed near an opening position, which is a stop position on the conveyance path, and that opens the spout attachment portion formed in the bag, a spout insertion and temporary sealing device that is installed near a spout insertion and temporary sealing position, which is a stop position on the conveyance path, that has a spout insertion member, which is ascended and descended substantially vertical and supports a spout, and a pair of temporary sealing members, which are disposed opposite to each other and movable toward and away from each other, and that inserts the spout into the spout attachment portion that has been opened by the opening device and temporarily seal the spout to the spout attachment portion with the temporary sealing member; and a final sealing device that is installed near a spout final sealing position, which is a stop position on the conveyance path, that has a pair of final sealing members disposed opposite each other and moved toward and away from each other, and that is used for the final sealing of the spout that was temporarily sealed to the spout attachment portion, to the spout attachment portion with the final sealing members.

In the apparatus for manufacturing a bag equipped with a spout according to the present invention, if needed, a corner cutting position for the bag is set, as a stop position on the conveyance path, between the bag supply position and the opening position. A corner cutting device that forms the spout attachment portion by cutting off the corner of a bag is installed near this corner cutting position.

According to the opening method and device of the present invention, in the spout attachment portion opening step, the spout attachment portion is opened by the suction of the pair of suction cups, and pressurized gas is then blown into the bag to inflate the bag, and when the gas is thus blown into the bag, the bag is fully inflated with the pressurized gas even if the bag is of the type that the top edge is not sealed, and the bag is able to have a stable opening shape.

DETAILED DESCRIPTION OF THE INVENTION

Figure 8B:
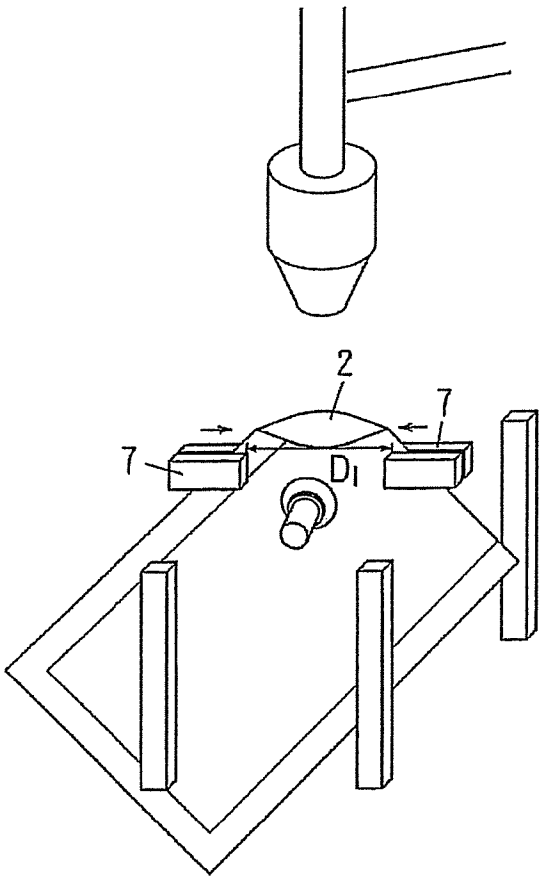
FIG. 8A and FIG. 8B illustrate in time sequence (8A and then 8B) the steps in the opening procedure in which still another type of clamping members is used.

The method and device for supplying bags equipped with spouts according to the present invention will be described below with reference to FIGS. 1 to 9B. In FIGS. 1 to 9B, those members and components that are substantially the same as those in FIG. 10 are numbered with the same reference numbers.

Figure 1:
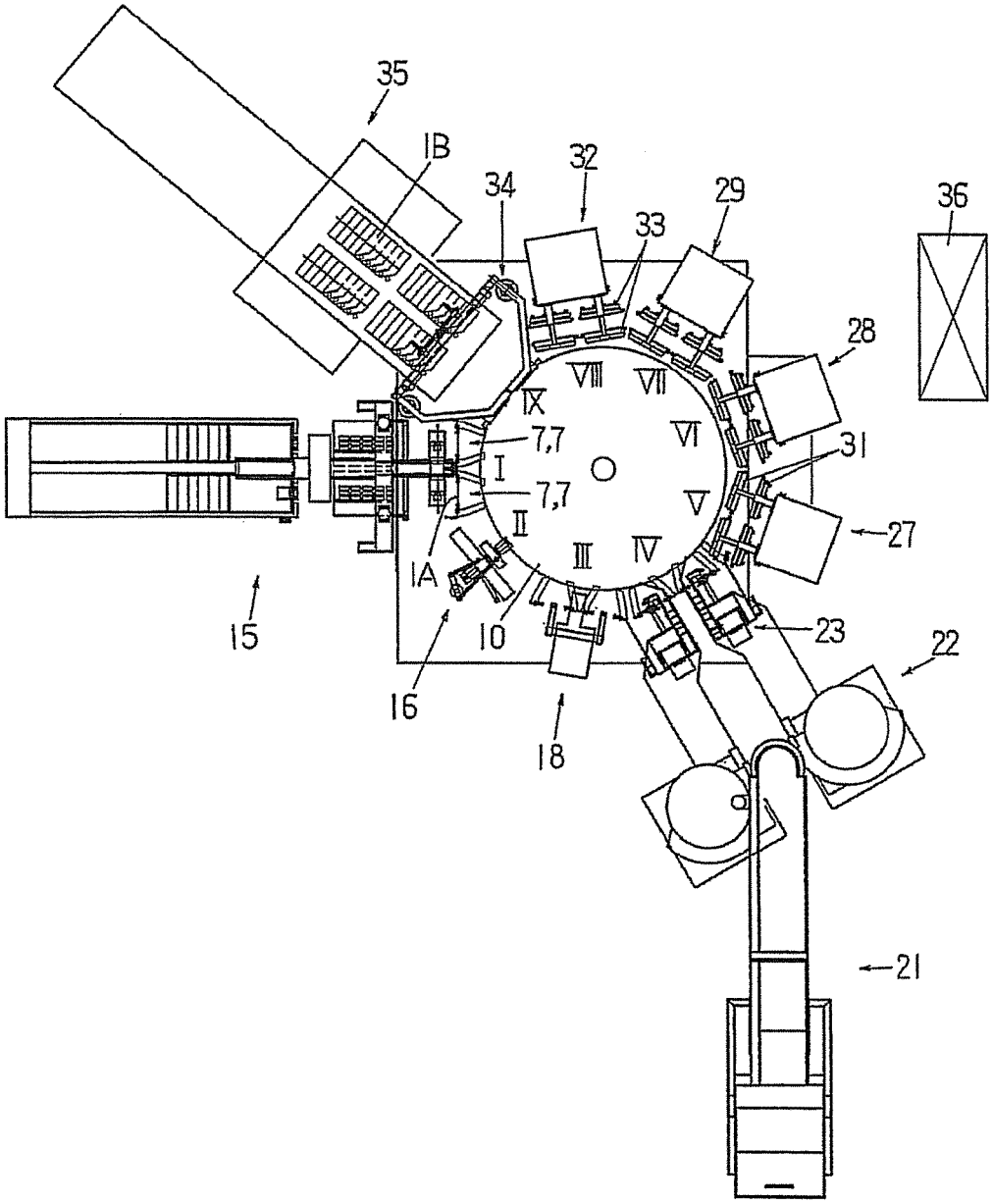
FIG. 1 is a top view of an apparatus for manufacturing a bag equipped with a spout according to the present invention.
Figure 2:
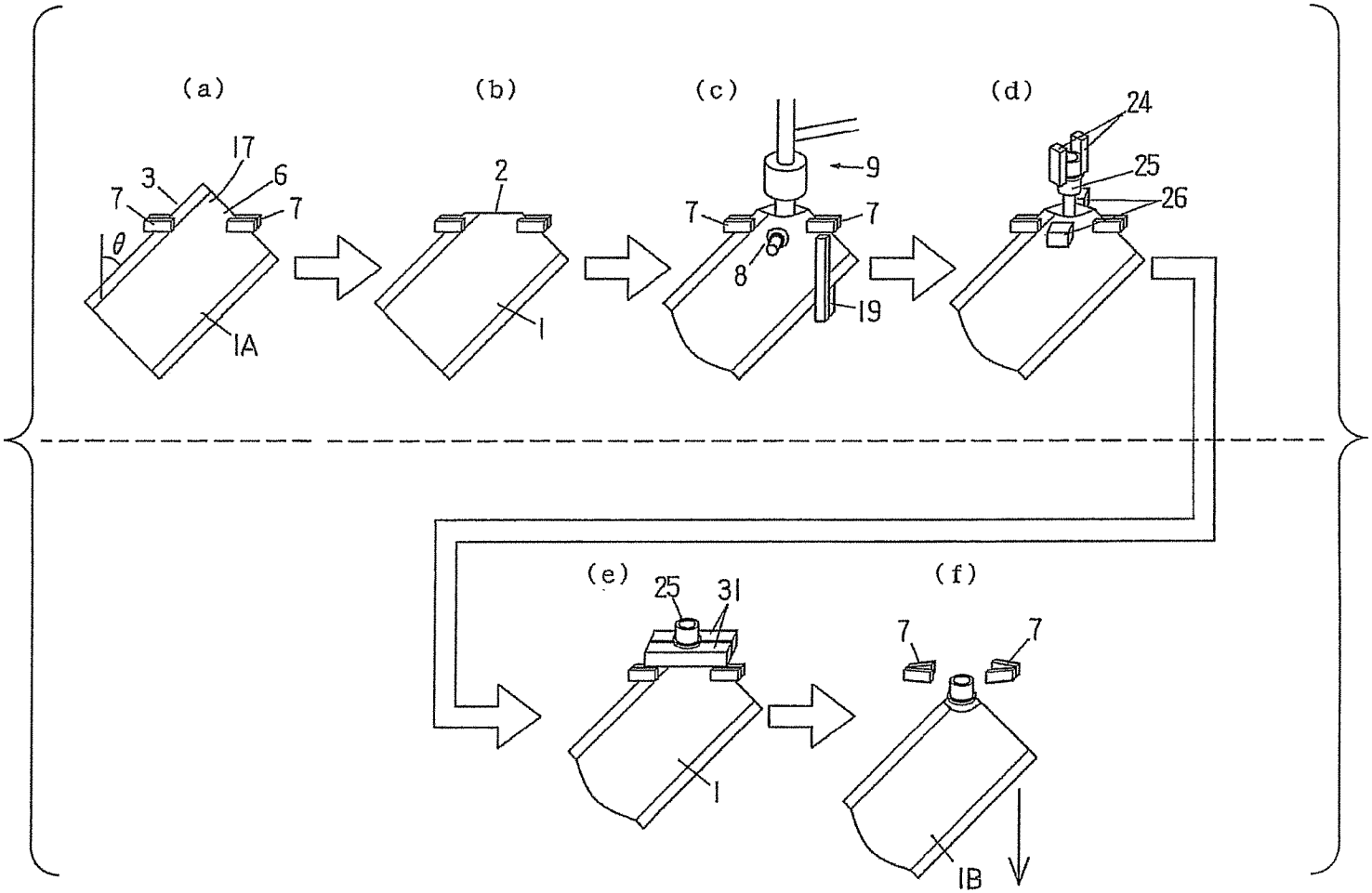
FIG. 2((*a*) through (*f*)) illustrates a series of steps performed by the apparatus for manufacturing a bag equipped with a spout shown in FIG. 1.

The rotary type apparatus for manufacturing bags equipped with spouts (spout attachment machine) shown in FIG. 1 includes a bag conveyance device in which a plurality of left and right pairs of grippers 7 are provided around a table 10 that rotates intermittently. The grippers 7 are moved intermittently along a circular conveyance path; and while the grippers are thus being moved, the bags clamped or held by the grippers are intermittently conveyed along the circular conveyance path. The grippers 7 are moved to come closer to each other and moved away from each other at a specific timing while being moved along the conveyance path. The shown rotary apparatus for manufacturing bags each equipped with a spout is what is known as a W type (twin line) apparatus, and thus two pairs of grippers 7 form one set, and two sets of pairs of grippers are provided at a regular spacing along the conveyance path; and various steps for attaching spouts simultaneously to two bags clamped by two pairs of grippers 7 are carried out successively.

As shown in FIG. 1, in this apparatus for manufacturing a bag equipped with a spout, a bag supply device 15 is disposed near a stop position I (bag supply step position) on the conveyance path. The bag supply device 15 is basically the same as the bag supply device illustrated in FIG. 1 of Patent Reference 1 (that comprises an empty bag storage device (12), a bag takeout device (13), a first supply device (28), and a second supply device (29)). A bag 1A (a square bag with its corner not has been cut) is positioned in a substantially horizontal orientation at the distal end of the bag storage device, and it is taken up and put in a substantially vertical orientation. The bag 1A is then rotated by a specific angle along the bag plane (side surfaces of the bag) and is moved a specific distance along the bag plane to be supplied to the grippers 7. The angle θ by which the bag 1A is rotated (see (a) in FIG. 2) is determined in advance based on the inclination angle of the spout attachment portion 2 formed in the bag. The grippers 7 clamp or hold, at a position that is slightly away from the corner distal end, the top edge 6 and the side edge 3 (see FIG. 10). In the above configuration, the bag supply device 15 supplies two bags 1A at a time.

A corner cutting device 16 is disposed near a stop position II (corner cutting step position) on the conveyance path. The corner cutting device 16 cuts off the corner 17 of the top edge 6 and the side edge 3 of the bag 1A (see (a) of FIG. 2) within a horizontal plane to form the spout attachment portion 2 (see (b) of FIG. 2). The bag with the corner thus cut is a bag 1 (which is the same as that shown in FIG. 10).

An opening device 18 is disposed near a stop position III (opening step position) on the conveyance path. As shown in (c) of FIG. 2, the opening device 18 comprises a pair of opening suction cups 8 (only one opening suction cup 8 is depicted) that are disposed to face both sides of the bag 1 and are able to move toward and away from each other, a gas blowing member 9 that is able to move up and down above the bag 1 that has stopped at the stop position III, and a clamping member 19 that can open and close. The opening suction cups 8 and the gas blowing member 9 are the same as those shown in FIG. 10. The clamping member 19 has clamping faces that run in the up and down direction; and when it closes, clamp both sides of the bag at a position under the gripper 7 (the right-side gripper in (c) of FIG. 2) that are positioned on the top edge 6 side of the bag.

The steps of the opening procedure of the bag will now be described below in more detail and in time sequence with reference to FIG. 3A through FIG. 4B.

Figure 3B:
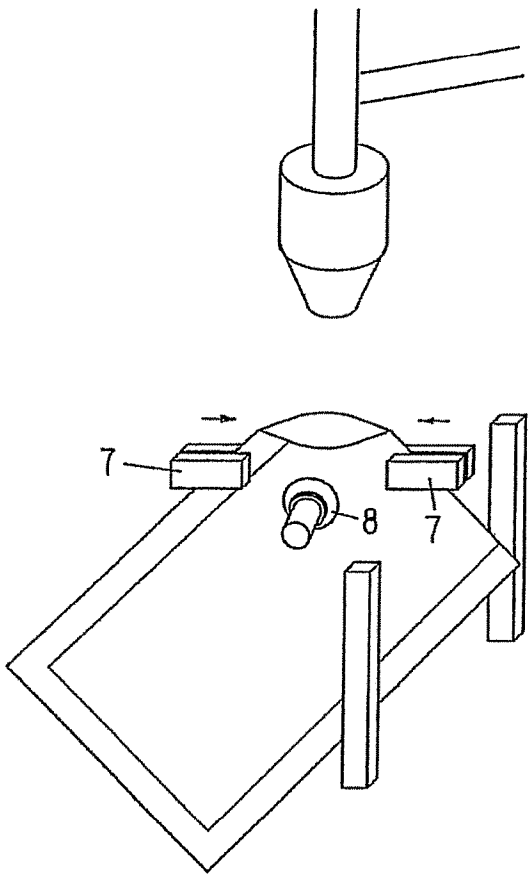
FIG. 3A and FIG. 3B illustrate in time sequence (3A and then 3B) the steps entailed by the opening procedure performed by the apparatus for manufacturing a bag equipped with a spout shown in FIG. 1.
Figure 3A:
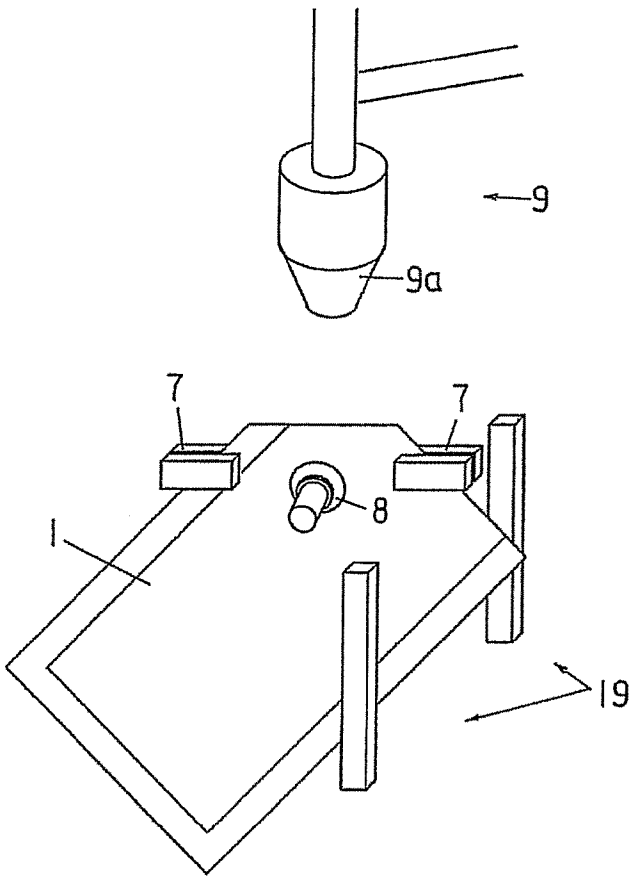

(1) As shown in FIG. 3A, when the bag 1 clamped by the grippers 7 is stopped at the stop position III, the opening suction cups 8 are moved closer together and suction-hold the films on both sides of the bag 1 near the spout attachment portion 2. At this point the gas blowing member 9 is in its ascended position, and the clamping member 19 opens and is retracted from the conveyance path of the bag 1.

(2) The opening suction cups 8 are moved apart or away from each other, and at the same time the grippers 7 are moved closer together (see FIG. 3B). As a result, the spout attachment portion 2 is opened.

Figure 4B:
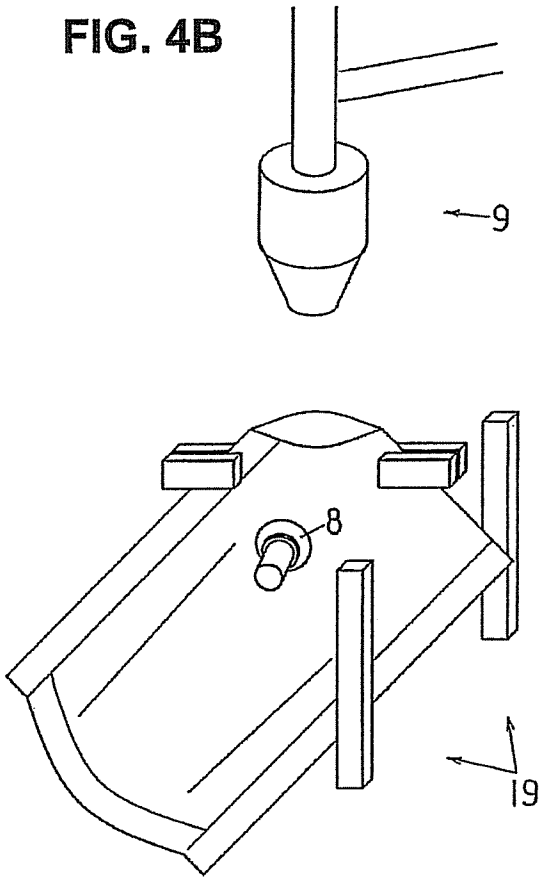
FIG. 4A and FIG. 4B illustrate in time sequence (4A and then 4B) the steps following the opening procedure of FIG. 3B.
Figure 4A:
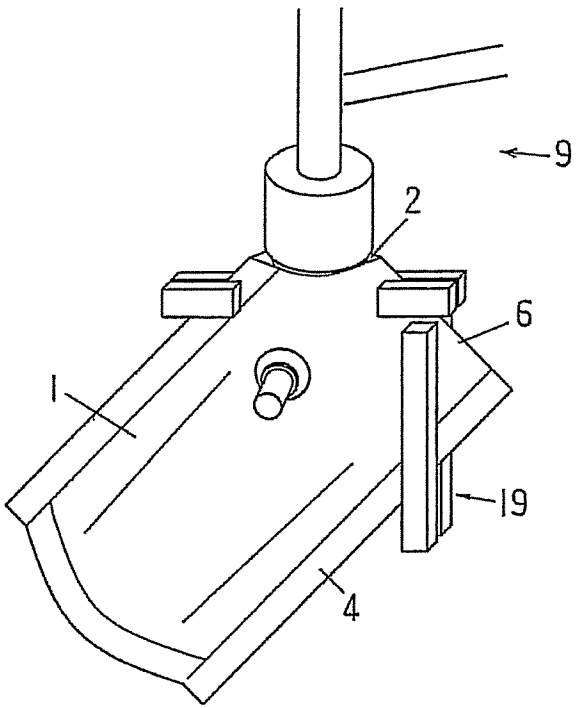

(3) Then, as shown in FIG. 4A, the gas blowing member 9 is descended, the lower end of the head 9*a* of the gas blowing member 9 goes into the bag through the opening of the spout attachment portion 2, substantially blocking off the opening of the spout attachment portion 2. Either simultaneously with the descending of the gas blowing member 9, or before or after it, the clamping member 19 closes and lightly clamp the bag 1 from both sides in the up and down direction at a position under the gripper 7 that is on the top edge 6 side of the bag. Then, pressurized gas is blown into the bag from the gas blowing member 9. The clamping member 19 clamps at a position under the gripper that is on the top edge 6 side and all the way to a position that reaches the side edge 4 substantially in the vertical direction of the bag; accordingly, the clamping member makes a situation that the escape path of the pressurized gas (the unsealed top edge 6) is to a large extent blocked off, and the pressurized gas is less likely to flow out of the bag from the top edge 6, and as a result, the pressurized gas proceeds farther into the interior of the bag 1 (see the region 14 in FIG. 10) and inflates substantially the entire bag 1.

The force exerted by the clamping member 19 to clamp the bag 1 is set to be enough to produce slippage between the films on both sides of the bag 1 and the clamping faces of the clamping member 19 when the bag 1 is inflated. Therefore, as the bag 1 is inflated, the films of the bag 1 can shift toward the center of the bag through the clamped portion, and this allows the entire bag 1 to be uniformly and completely inflated, without any distortion.

(4) When the bag 1 has been inflated, the blowing of the pressurized gas from the gas blowing member 9 is stopped, and then the gas blowing member 9 is ascended. The suction of the suction cups 8 is stopped, and then the suction cups 8 are retracted to their original positions, and the clamping member 19 is opened (see FIG. 4B) and are retracted from the conveyance path of the bag 1. At this point, the bag 1 is sufficiently inflated; accordingly, the opening shape of the spout attachment portion 2 is stable and kept maintained "as is". The grippers 7 are then moved and convey the bag 1 toward the next stop position IV (spout insertion and temporary sealing step position).

Near the stop position IV on the conveyance path (spout insertion and temporary sealing step position), as seen from FIG. 1, a spout supply conveyor 21, a parts feeder 22, and a spout insertion and temporary sealing device 23 are disposed. The spout insertion and temporary sealing device 23, as shown in (d) of FIG. 2, inserts a spout 25 that is held by a spout insertion member 24 into the center of the opening of the opened spout attachment portion 2, then the spout 25 is squeezed from the outside of the bag 1 by a pair of spout temporary sealing members 26 (hot plates) so that the spout 25 is sealed temporarily to the films on both sides of the bag 1. After the insertion of the spout 25, the grippers 7 are moved away from each other so as to close the opening of the spout attachment portion 2.

As seen from FIG. 1, a first sealing device 27 is disposed near the stop position V (first sealing step position) on the conveyance path, a second sealing device 28 is disposed near the stop position VI (second sealing step position), and a third sealing device 29 is disposed near the stop position VII (third sealing step position). The first sealing device 27 squeezes the bag 1 and the spout 25 with a pair of hot plates 31 thereof as shown in (e) of FIG. 2 and executes final sealing to the bag 1 and the spout 25 (in which the spout 25 is sealed to the films on both sides of the spout attachment portion 2 of the bag 1, and at the same time the films on both sides of the spout attachment portion 2 of the bag 1 are sealed together). This final sealing is performed in the same way by the second sealing device 28 and by the third sealing device 29. Performing the final sealing step just once or many times repeatedly can be selected optionally.

A cooling device 32 is disposed near the stop position VIII (cooling step position, see FIG. 1) on the conveyance path. The cooling device 32 squeezes the bag 1 and the spout 25 with a pair of cooling plates 33 to cool the heated sealed portions of the bag 1 and the spout 25.

A bag discharge device 34 and a conveyor 35 are disposed near the stop position IX (discharge step position) on the conveyance path. The grippers 7 are opened (see (f) FIG. 2), the bag discharge device 34 receive two finished bags 1B (bags equipped with spouts) together, and then the bag discharge device 34 arranges the bags 1B on the conveyor 35. On the conveyor 35, the following bags come in under the preceding bags (see FIG. 7 in Japanese Patent Application Laid-Open (Kokai) No. H8-337217), and numerous bags 1B are stacked in a state of being offset in the bag width direction by about one-third the bag width. The conveyor 35 is a conveyor magazine type conveyor that supplies the bags 1B equipped with spouts to a filling device (not shown), and the numerous stacked bags 1B are supplied "as is" to the filling device.

In FIG. 1, the reference numeral 36 is a control device. The control device 36 controls all of the devices that make up the apparatus for manufacturing bags having spouts shown in FIG. 1. In other words, the control device 36 controls the above-described bag conveyance device (the table 10, the grippers 7, etc.), the bag supply device 15, the corner cutting device 16, the opening device 18, the spout insertion and temporary sealing device 23, etc.

Figure 5:
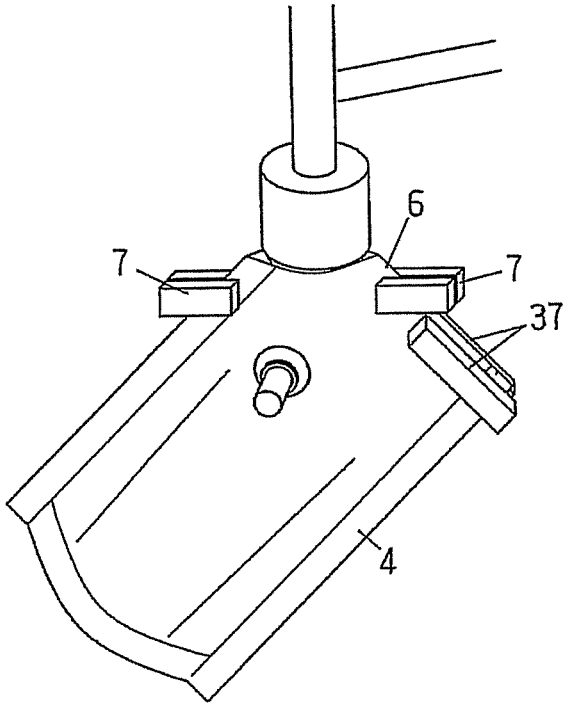
FIG. 5 illustrates another example of clamping members used in the opening procedure of the present invention.

FIG. 5 shows an example of another type of clamping member of the present invention.

The clamping member 37 shown in FIG. 5 is the same as the clamping member 19 in that it clamps or holds both sides of the bag 1 at a position under the gripper 7 which is on the top edge 6 side all the way to the side edge 4 of a bag; however, it differs from the clamping member 19 described above in that it is provided at an to the horizontal plane so as to be substantially parallel to the top edge 6 of the bag.

When the clamping member 37 is used, just as in the case of the clamping member 19, the escape path of the pressurized gas (the unsealed top edge 6) is blocked off, and it is less likely that the pressurized gas will flow out of the bag from the top edge 6; and as a result, the pressurized gas proceeds well into the interior of the bag 1 and inflates substantially the entire bag 1. In any case, the clamping members of the present invention clamp the bag 1 in any form, so as long as the pressurized gas is prevented to a certain extent from freely flowing out of the bag from the top edge 6 of the bag, and the clamping members help to inflate the bag 1 completely.

FIGS. 6A through 7B illustrate in time sequence the opening procedure when still another type of clamping members are used. In the opening procedure shown in FIGS. 6A through 7B, left and right pairs of clamping members 38 and 39 are used. The bag 1, the opening suction cups 8, and the gas blowing member 9 are the same as those shown in FIGS. 3A through 4B. The clamping members 38 and 39 both have clamping faces that run in the up and down direction; and when they close, the right-side clamping member 38 clamps from both sides of the bag 1 at a position under the gripper 7 which is on the top edge 6 side, and the left-side clamping member 39 clamps at a position under the gripper 7 which is on the side edge 3 side.

The steps of bag opening procedure of the clamping members 38 and 39 will be described in detail and in time sequence with reference to FIGS. 6A through 7B.

Figure 6B:
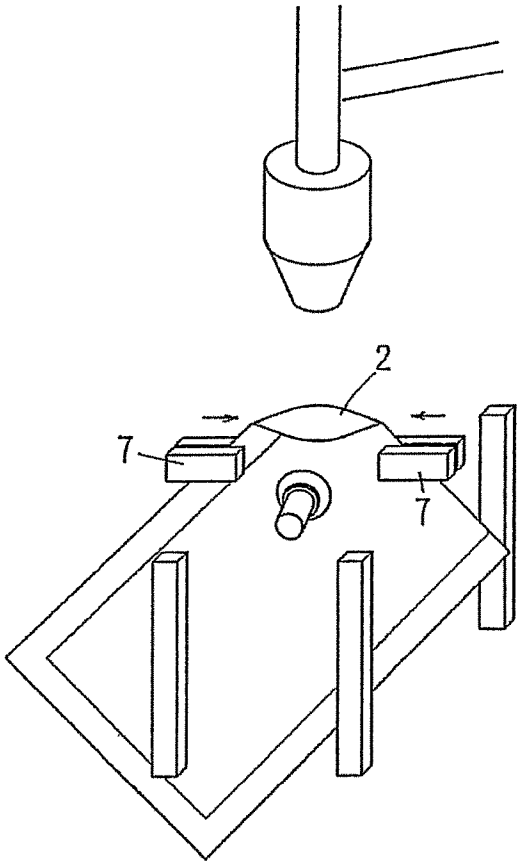
FIG. 6A and FIG. 6B illustrate in time sequence (6A and then 6B) the steps taken in the opening procedure in which the clamping members of FIG. 5 are used.
Figure 6A:
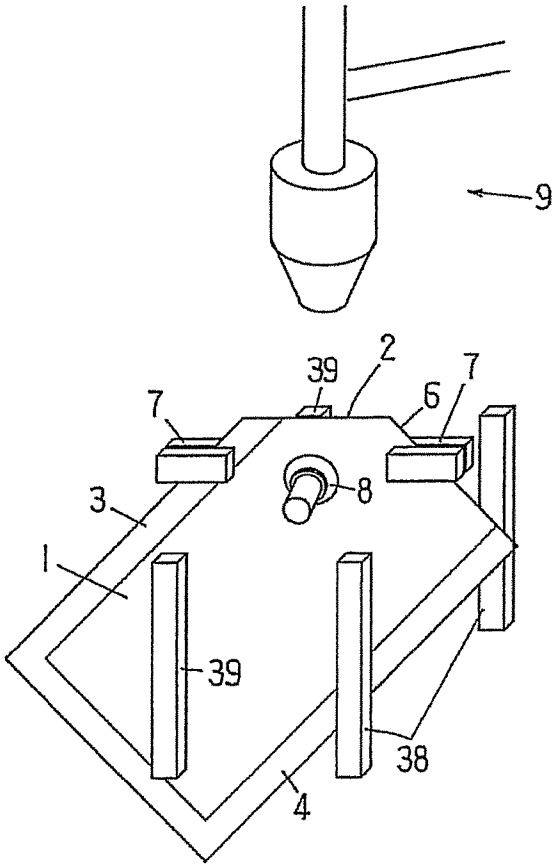

(1) As shown in FIG. 6A, when the bag 1 clamped by the grippers 7 stops at the stop position III (see FIG. 1), the opening suction cups 8 are moved closer to each other and suction-hold both side planes (both side surfaces) of the bag 1 near the spout attachment portion 2. At this point, the gas blowing member 9 is in its ascended position, and the clamping members 38 and 39 open and are retracted from the conveyance path of the bag 1.

(2) The opening suction cups 8 are moved apart or away from each other, and at the same time the grippers 7 are moved closer to each other (see FIG. 6B) as indicated by arrows. As a result, the spout attachment portion 2 of the bag 1 is opened.

Figure 7B:
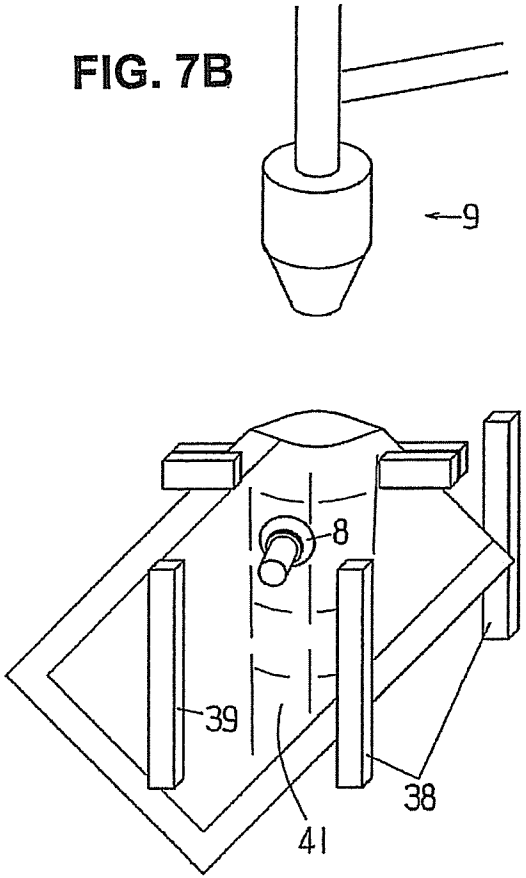
FIG. 7A and FIG. 7B illustrate in time sequence (7A and then 7B) the steps following the opening procedure of FIG. 6B.
Figure 7A:
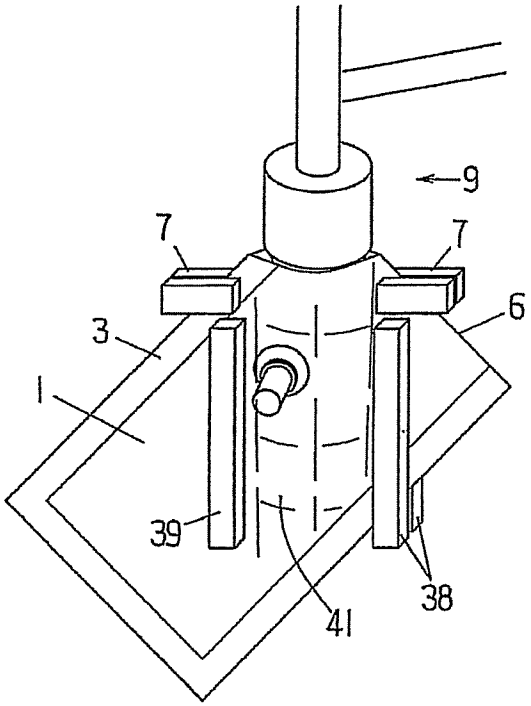

(3) As shown in FIG. 7A, the gas blowing member 9 is then descended, and the lower end of the head 9*a* is inserted into the bag 1 from the opening of the opened spout attachment portion 2, substantially blocking off the opening of the spout attachment portion 2. Either simultaneously with the descending of the gas blowing member 9, or before or after it, the clamping member 38 closes and the clamping member 39 also closes, thus lightly clamping the bag 1 from both sides of the bag substantially in the vertical direction, with the clamping member 38 at a position under the gripper 7 (right side gripper 7) that is on the top edge 6 side, and the clamping member 39 at a position under the gripper 7 (left side gripper 7) on the side edge 3 side. The lower end of the clamping member 38 clamping the bag 1 reaches all the way to the side edge 4 of the bag 1. As to the manner the clamping members 38 and 39 clamp the bag 1, it can be said that the clamping members 38 and 39 clamp, in the up and down direction, positions that are under both end portions of the opened spout attachment portion 2. Pressurized gas is then blown into the bag from the gas blowing member 9. The pressurized gas goes into a region 41 (the region directly under the opened spout attachment portion 2) squeezed by the clamping members 38 and 39 inside the bag 1, while the clamping member 38 clamps the position under the gripper on the top edge 6 side and thereby blocks off to a considerable extent the escape path of the pressurized gas (the unsealed top edge 6), so that the pressurized gas is less likely to flow out of the bag from the top edge 6, and as a result mainly the region 41 of the bag is inflated.

The force exerted by the clamping members 38 and 39 when clamping the bag 1 is set to be the same as that of the clamping member 19, so that that force is enough to produce slippage between the films on both sides of the bag 1 and the clamping faces of the clamping members 38 and 39 when the bag 1 is inflated. Therefore, as the region 41 of the bag 1 is inflated, the films of the bag 1 move toward the center through the clamped positions, and this allows the bag 1 to be completely inflated in the region 41 clamped by the clamping members 38 and 39.

(4) The blowing of the pressurized gas from the gas blowing member 9 is, next, stopped, and then the gas blowing member 9 is ascended, the suction of the suction cups 8 is stopped, the suction cups 8 are retracted to their original positions, and the clamping members 38 and 39 open and are retracted from the conveyance path of the bag 1. Since the region directly under the spout attachment portion (the region 41) is thoroughly inflated (to the same extent as the opening shape of the spout attachment portion 2) in the up and down direction, the opening shape of the spout attachment portion 2 is stable and kept maintained. The grippers 7 are then moved and convey the bag 1 toward the next stop position IV (spout insertion and temporary sealing step position).

FIGS. 8A through 9B illustrate in time sequence an opening procedure in which a still another type of clamping members are used; and in the opening procedure shown in FIGS. 8A through 9B, left and right pairs of clamping members 42 and 43 are used. The bag 1, the opening suction cups 8, and the gas blowing member 9 are the same as those shown in FIGS. 6A through 7B. The shape and layout of the clamping members 42 and 43 are substantially the same as those of the clamping members 38 and 39; however, the difference from the clamping members 38 and 39 is that the clamping members 42 and 43 is movable closer to each other and separated from each other.

The steps involved in the opening procedure of the bag 1 will be described below in detail and in time sequence with reference to FIGS. 8A through 9B.

Figure 8A:
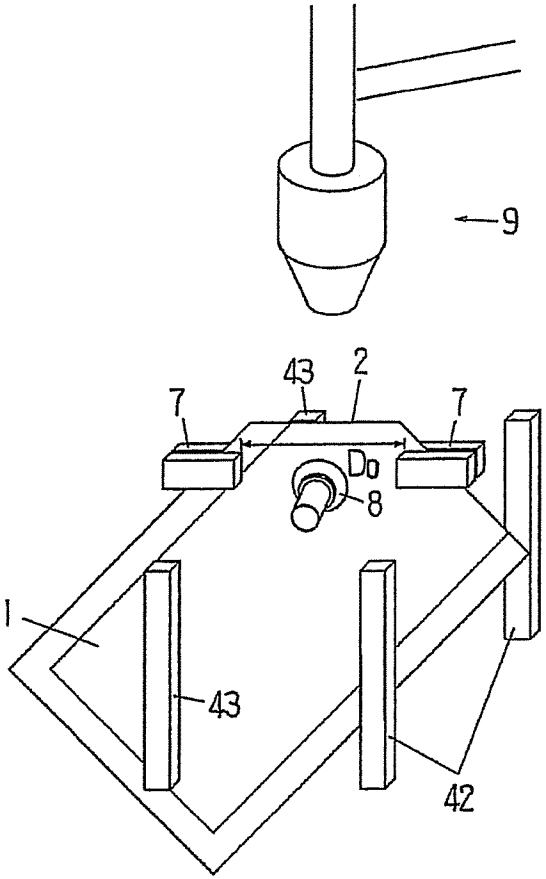
Figure 9B:
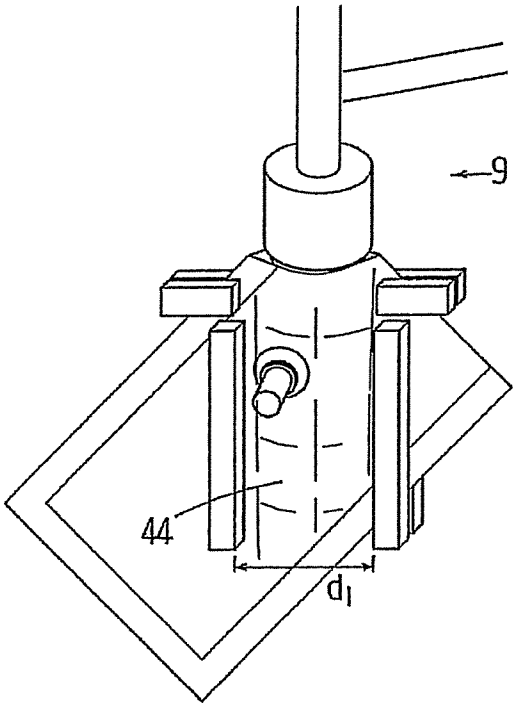
FIG. 9A and FIG. 9B illustrate in time sequence (9A and then 9B) the steps following the opening procedure of FIG. 8B.

(1) As shown in FIG. 8A, when the bag 1 clamped by the grippers 7 is stopped at the stop position III (see FIG. 1), the opening suction cups 8 are moved closer to each other and suction-hold both sides of the bag 1 near the spout attachment portion 2 of the bag. At this point, the gas blowing member 9 is at its ascended position, and the clamping members 42 and 43 open and are retracted from the conveyance path of the bag 1.

(2) The opening suction cups 8 are next moved away from each other, and at the same time the grippers 7 are moved so that the spacing of the grippers 7 is narrowed from D0 to D1 (see FIGS. 8A and 8B). This opens up the spout attachment portion 2 of the bag 1.

Figure 9A:
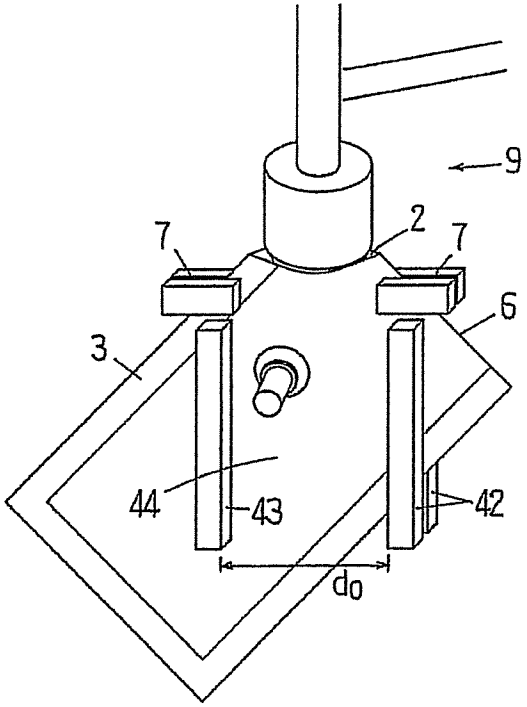
Figure 10:
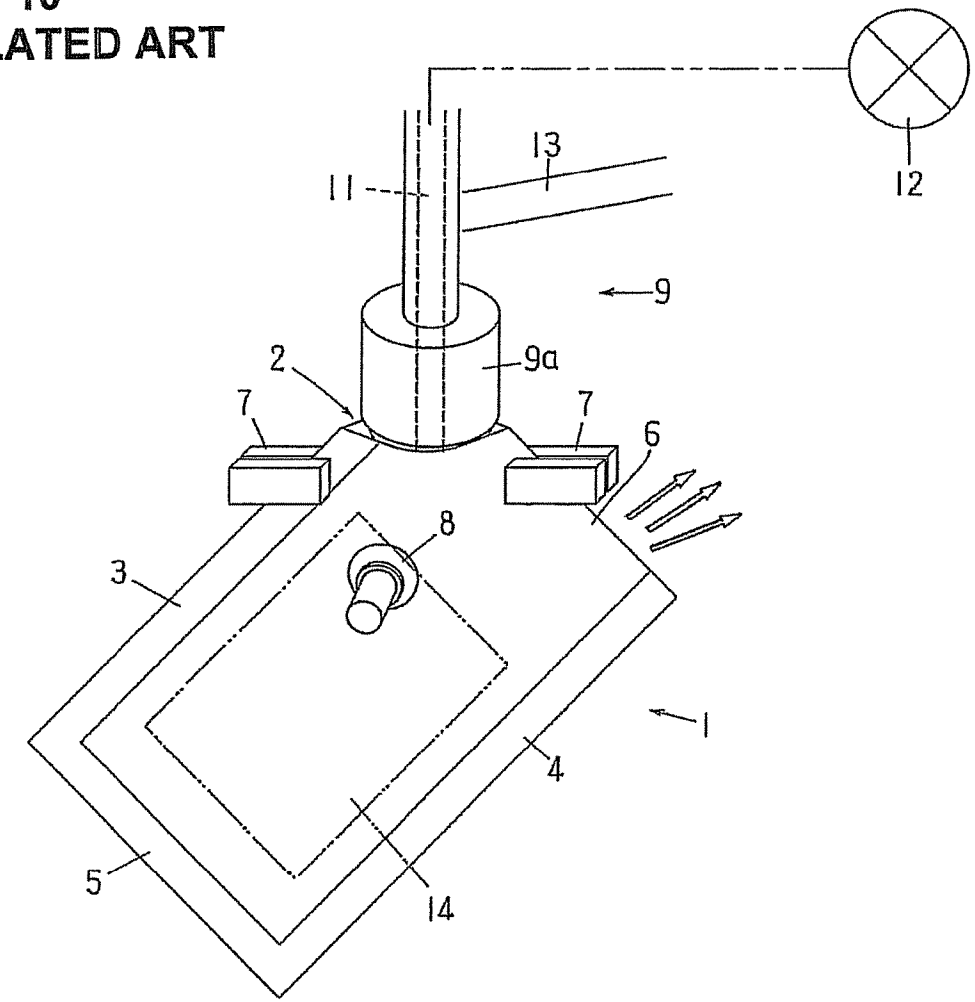
FIG. 10 RELATED ART
FIG. 10 illustrates the problems encountered with a conventional opening device.

(3) As shown in FIG. 9A, the gas blowing member 9 is then descended, and the lower end of the head 9*a* is inserted into the bag from the opening of the spout attachment portion 2, thus substantially blocking off the opening of the spout attachment portion 2. Either simultaneously with the descending of the gas blowing member 9, or before or after it, the clamping members 42 and 43 close and clamp the bag 1 from both sides of the bag substantially in the vertical direction, so that the clamping member 42 holds the bag at a position under the grippers 7 on the top edge 6 side and the clamping member 43 holds the bag at a position under the gripper 7 on the side edge 3 side. It can thus be said that the clamping members 42 and 43 clamp (hold) in the up and down direction, under positions at both ends of the opened spout attachment portion 2. In the above respects these are the same as the previously described clamping members 38 and 39; however, the spacing d0 between the clamping members 42 and 43 when clamping or holding the bag is set slightly wider than the spacing between the clamping members 38 and 39. The force exerted by the clamping members 42 and 43 when clamping the bag 1 can be set to be the same as that of the clamping members 38 and 39 so as to be enough to produce slippage between the films on both sides of the bag 1 and the clamping faces of the clamping members 42 and 43 when the bag 1 is inflated; or the clamping force can be set higher than that of the clamping members 38 and 39, so that no slippage is produced.

(4) As shown in FIG. 9B, pressurized gas is then blown into the bag from the gas blowing member 9. The pressurized gas goes into a region 44 of the bag (the region directly under the opened spout attachment portion 2) which is squeezed by the clamping members 42 and 43, while the clamping member 42 clamps the position under the gripper on the top edge 6 side (the unsealed top edge 6) and thereby blocks off to a considerable extent the escape path of the pressurized gas, so that the pressurized gas is less likely to flow out of the bag from the top edge 6, and as a result mainly the region 44 is inflated. Also, the spacing d1 between the clamping members 42 and 43 is narrowed to match the timing at which the pressurized gas is blown in. The movement of the clamping members 42 and 43 here (d0-d1) is set to be substantially equal to the amount of movement of the grippers 7 (D0-D1).

If the force exerted when the clamping members 42 and 43 clamp the bag 1 is sufficiently high, no slippage will occur between the films on both sides of the bag 1 and the clamping faces of the clamping members 42 and 43 even after the bag 1 is inflated. However, even in this case, as the bag 1 inflates, the spacing between the clamping members 42 and 43 narrows (d0→d1), as a result, the bag 1 can be inflated without hindrance in the region 44 squeezed by the clamping members 42 and 43. Even if the exerted force is low when the clamping members 42 and 43 clamp the bag 1, since the spacing of the clamping members 42 and 43 is narrowed, there may be a case that substantially no slippage occurs between the films on both sides of the bag 1 and the clamping faces of the clamping members 42 and 43.

(5) The blowing of the pressurized gas from the gas blowing member 9 is next stopped, and then the gas blowing member 9 is ascended, the suction cups 8 are retracted to their original positions, and then the clamping members 42 and 43 opened and are retracted from the conveyance path of the bag 1. However, since the region directly under the spout attachment portion (the region 44) is thoroughly inflated along the up and down direction (to the same extent as the opening shape of the spout attachment portion 2), the opening shape of the spout attachment portion 2 is stable and kept "as is". The grippers 7 are then moved and convey the bag 1 toward the next stop position IV (spout insertion and temporary sealing step position).

The embodiments of the method and device for opening a spout attachment portion of a bag and of the apparatus for manufacturing a bag equipped with a spout according to the present invention are as described above, and the present invention further provides such embodiments as those described below:

(1) In the above examples, the bag 1 supplied from the bag supply device 15 to the grippers 7 is the square bag 1A that has no corner-cut, so that the apparatus for manufacturing a bag equipped with a spout performs corner cutting and forms the spout attachment portion 2 at this corner. However, as disclosed in Patent Reference 1, a bag (the bag 1) that has a corner-cut made in advance can be supplied to the grippers 7. In this case, the corner cutting step on the conveyance path of the bag 1 is not necessary.

(2) In the above examples, the bag supply device 15 is basically the same as the bag supply device shown in FIG. 1 of Patent Reference 1; however, the bag supply device disclosed in, for instance, Japanese Patent Application No. 2014-043864 can also be used. This bag supply device includes a conveyor magazine (7), a rotary conveyance device (5) that suction-holds a bag positioned in a substantially horizontal orientation at the end of a conveyor magazine and lifts it up "as is" then conveys the bag forward, and rotates it by a specific angle within the horizontal plane, and a positioning conveyor (6) that receives the bag from the rotary conveyance device and readjusts the position and angle (θ) of the bag, and further a bag conveyance device (57) that uses a suction cup to grab the bag positioned at the end of the positioning conveyor, lifts up the bag, switches the bag to a substantially vertical orientation with a chuck, and supplies it to grippers 7 (the numbers in parentheses indicate that these reference numbers are those used in Japanese Patent Application No. 2014-043864).

(3) The apparatus for manufacturing a bag equipped with a spout described for the above examples is a spout attachment machine that merely attaches the spout 25 to the bag 1; however, the device can be designed so that bag 1 is filled with a liquid. In this case, after the spout attachment step is done, the spout attachment machine opens the top edge 6 of the bag (while still being clamped by the same grippers 7) on the same conveyance path, then it fills the bag 1 with the liquid through the top edge 6 and seals the top edge 6 after filling. In this case, the bag equipped with a spout that is manufactured is an already-filled bag.

(4) In the above examples, the spout attachment portion 2 is opened by the opening suction cups 8, and the clamping members 19, 38 and 39, and 42 and 43 close to clamp the bag 1, and after which pressurized gas is blown in from the gas blowing member 9 into the bag. However, the blowing in of the pressurized gas can be started before the opening of the spout attachment portion 2 or before the closing of the clamping members. In any case, the timing of the opening of the spout attachment portion 2, the clamping by the clamping members, and the start of the blowing of the pressurized gas can be selected as desired.

(5) In the above examples, the clamping members 38 and 39 open and close at the same timing; however, the opening and closing timing can be different timing between the clamping members 38 and the clamping members 39. The same applies to the clamping members 42 and 43.

(6) In the above examples, when the gas blowing member 9 is descended, the lower end of the head 9*a* is inserted into the opening of the spout attachment portion 2, thus substantially blocking off the opening of the spout attachment portion 2, which prevents the opening of the spout attachment portion 2 from becoming an escape path for the pressurized gas, so that the bag 1 is reliably inflated with the pressurized gas; however, this is not essential. The present invention can be carried out even if the blow hole at the lower end of the gas blowing member 9 is not inserted into the opening of the spout attachment portion 2.

The invention claimed is:

1. A method for opening a spout attachment portion, the method comprising:

providing a pair of grippers, clamping, with the pair of grippers, both sides of a spout attachment portion of a bag in which a corner at a top edge and one of side edges of the bag has been cut to form the spout attachment portion; and conveying, with the pair of grippers, the bag along a specific conveyance path while having the bag hung down so that the spout attachment portion is substantially horizontal, providing a pair of suction cups, suction-holding, with the pair of suction cups, films on both sides of the spout attachment portion of the bag during the conveyance, and widening a spacing between the pair of suction cups to open the spout attachment portion, and thereafter providing a gas blowing member, blowing, with the gas blowing member, a gas into the bag to inflate the bag, wherein the bag is unsealed at the top edge, and providing a clamping member, and clamping, by the clamping member and when the gas is blown into the bag by the gas blowing member, a position under the gripper that is disposed on the top edge side of the bag from both sides of the bag, thus suppressing outflow of the gas blown into the bag from the top edge, wherein the position clamped by the clamping member is offset from a position of the spout attachment portion along the top edge side of the bag.

2. The method for opening a spout attachment portion according to claim 1, wherein when the bag is inflated, slippage is allowed to occur between the films and a clamping face of the clamping member.

* * * * *